US012414592B2

(12) United States Patent
McCray

(10) Patent No.: US 12,414,592 B2
(45) Date of Patent: Sep. 16, 2025

(54) MEDICAL ACCESS GARMENT

(71) Applicant: Treva McCray, Effingham, SC (US)

(72) Inventor: Treva McCray, Effingham, SC (US)

( * ) Notice: Subject to any disclaimer, the term of this patent is extended or adjusted under 35 U.S.C. 154(b) by 0 days.

(21) Appl. No.: 18/394,045

(22) Filed: Dec. 22, 2023

(65) Prior Publication Data

US 2025/0204623 A1 Jun. 26, 2025

(51) Int. Cl.
*A41D 13/12* (2006.01)

(52) U.S. Cl.
CPC ..... *A41D 13/129* (2013.01); *A41D 13/1245* (2013.01)

(58) Field of Classification Search
CPC .. A41D 13/129; A41D 13/1245; A41D 13/04; A41D 2400/44
See application file for complete search history.

(56) References Cited

U.S. PATENT DOCUMENTS 459,106 A * 9/1891 Fifield ..... A41D 15/00 2/139
782,819 A * 2/1905 Bikle ..... A47G 9/08 2/114
818,351 A * 4/1906 Clark ..... A41D 13/1236 2/114
1,152,854 A * 9/1915 Simpson ..... A41D 13/04 2/51
1,489,046 A * 4/1924 Thompson ..... A41B 9/08 2/269
2,499,689 A * 3/1950 Sossamon ..... A41B 13/10 2/48
2,722,686 A * 11/1955 Hoskings ..... A41D 15/00 D2/800
3,116,491 A * 1/1964 Previdi ..... A41D 1/21 2/76
4,145,763 A * 3/1979 Abrams ..... A41D 13/129 2/403
4,258,440 A * 3/1981 McGowan ..... A41D 13/1236 2/403
4,581,772 A * 4/1986 Smith ..... A61F 13/496 2/111
4,764,986 A * 8/1988 Stewart ..... A41D 13/129 2/135
4,969,215 A * 11/1990 Burkett ..... A41D 13/1236 2/114
5,315,716 A * 5/1994 Baum ..... A41D 1/06 2/912

(Continued)

FOREIGN PATENT DOCUMENTS

EM 000844881-0001 6/2008
EM 000844881-0002 6/2008

(Continued)

*Primary Examiner* — Jillian K Pierorazio
(74) *Attorney, Agent, or Firm* — Dunlap Bennett & Ludwig, PLLC; Anna L. Kinney

(57) ABSTRACT

A medical access garment includes a unitary front panel having a first plurality of fasteners arrayed along a left edge and a right edge; a unitary back panel having a second plurality of fasteners mated to the first plurality of fasteners along a left edge and a right edge; and an elastic member joining the unitary front panel to the unitary back panel. The unitary front panel and the unitary back panel when in a fastened position form openings for a patient's torso and extremities.

10 Claims, 4 Drawing Sheets

(56) References Cited

U.S. PATENT DOCUMENTS 5,359,731 A * 11/1994 Cavalier ..... A41D 13/02 2/46
5,564,123 A * 10/1996 Grassick ..... A41D 13/1245 2/70
D378,157 S * 2/1997 Jagger ..... D2/718
5,991,923 A * 11/1999 Maria ..... A41D 13/1236 2/114
6,012,166 A * 1/2000 Burbidge ..... A41D 13/129 2/114
RE36,869 E * 9/2000 Ewen ..... A41C 3/148 2/108
6,282,718 B1 * 9/2001 Drakford ..... A41D 15/00 2/70
6,571,395 B1 * 6/2003 Korkor ..... A41D 13/1245 2/45
D574,126 S * 8/2008 McCray ..... D2/720
7,827,619 B1 * 11/2010 Steinberg ..... A41D 11/00 2/114
D668,840 S * 10/2012 McCray ..... D2/738
10,271,594 B1 * 4/2019 Cook ..... A41D 13/1245
2003/0126668 A1 * 7/2003 Scroggins ..... A41D 13/1236 2/114
2005/0039702 A1 * 2/2005 Laffoon ..... A01K 27/00 119/850
2006/0037121 A1 * 2/2006 Park ..... F41H 5/0485 2/2.5
2010/0235964 A1 * 9/2010 Mickey ..... A41D 13/129 112/475.13
2012/0054946 A1 * 3/2012 Griffith ..... A41B 9/00 2/400
2012/0090072 A1 * 4/2012 Oprandi ..... A41D 27/20 2/114
2012/0246796 A1 * 10/2012 Dunn ..... A41D 13/129 2/114
2014/0173803 A1 * 6/2014 McCollum ..... A41D 13/1272 2/114
2015/0059048 A1 * 3/2015 Stanley ..... A41D 13/129 2/69
2015/0101102 A1 * 4/2015 Theodossiou ..... A41D 13/1245 2/114
2015/0157069 A1 * 6/2015 Hieber ..... A41D 13/129 2/114
2015/0374048 A1 * 12/2015 Theodossiou ..... A41D 13/1245 2/114
2016/0366957 A1 * 12/2016 Chen Tsai ..... A41D 13/129
2018/0014586 A1 * 1/2018 Bok ..... A41D 13/129
2019/0200739 A1 * 7/2019 Green Mullins .. A41D 13/0012
2021/0052025 A1 * 2/2021 Colon-Alfonso ..... A41D 27/10
2021/0289855 A1 * 9/2021 Colon-Alfonso ..... A41D 13/1245
2023/0010404 A1 * 1/2023 Riddle ..... A41D 15/00

FOREIGN PATENT DOCUMENTS

EM 000844881-0003 6/2008
EM 000844881-0004 6/2008
EM 000844881-0005 6/2008
EM 000844881-0006 6/2008
EM 000844881-0007 6/2008
EM 000844881-0008 6/2008
EM 000844881-0009 6/2008
EM 000844881-0010 6/2008
EM 000844881-0011 6/2008
EM 000844881-0012 6/2008
EM 000844881-0013 6/2008
EM 000844881-0014 6/2008

* cited by examiner

MEDICAL ACCESS GARMENT

BACKGROUND OF THE INVENTION

The present invention relates to apparel and, more particularly, to a medical access garment.

In medical settings, such as hospitals or other medical treatment facilities, patients endure a lack of privacy and discomfort when wearing hospital or treatment robes or other hospital apparel. Privacy is frequently insufficient in semi-private settings, such as MRI or other medical testing locations, OB-GYN clinics, physical therapy clinics, medical spas, or beauty spas. Currently available medical garments may require the wearer to reach over the head, bend to disrobe, or be partially undressed for medical examinations.

Moreover, privacy may be sacrificed in a public place, resulting in exposure when breast feeding or nursing, expressing breast milk, or the like.

For individuals who dislike personal exposure in the foregoing types of settings and environments, a solution is needed.

As can be seen, there is a need for a medical garment which provides convenient access and provides improved privacy to prevent exposure, assisting patients in maintaining their dignity and confidence in the face of medical examinations and treatment.

SUMMARY OF THE INVENTION

In one aspect of the present invention, a medical access garment comprises a unitary front panel having a first plurality of fasteners arrayed along a left edge and a right edge; a unitary back panel having a second plurality of fasteners mated to the first plurality of fasteners along a left edge and a right edge; and an elastic member joining the unitary front panel to the unitary back panel; wherein the unitary front panel and the unitary back panel when in a fastened position form openings for a patient's torso and extremities.

Traditional medical clothes are revealing, unattractive, and create embarrassing moments for not only patients, but also hospital staff. It is time to bring the traditional gown to a close, and the medical garments of the present invention provide better options. The medical garment of the present invention differs from and distinguishes over the previously existing available garments. It has a specific design which may cover private parts of the body to maximize privacy and still provide convenient accessibility to private areas for testing and treatment, enabling a medical provider (e.g., nurse or doctor) to assist patients without complete exposure. Patients dislike exposure, and the medical garment provides a classier way to get the job done. The patient will no longer need to reach overhead or bend over to disrobe for medical provider assistance, procedures, and x-rays. The medical garment may be beneficially worn for breast feeding, nursing, and breast exams; and may be used in OB-GYN clinics, for physical therapy, medical or beauty spa services, and the like. Patients who wear the medical garment may retain or regain their privacy, confidence and enjoy the convenience. Because of the ease of use provided by the medical garment, some wearers may regain their independence through its use.

These and other features, aspects and advantages of the present invention will become better understood with reference to the following drawings, description, and claims.

DETAILED DESCRIPTION OF THE INVENTION

Figure 1:
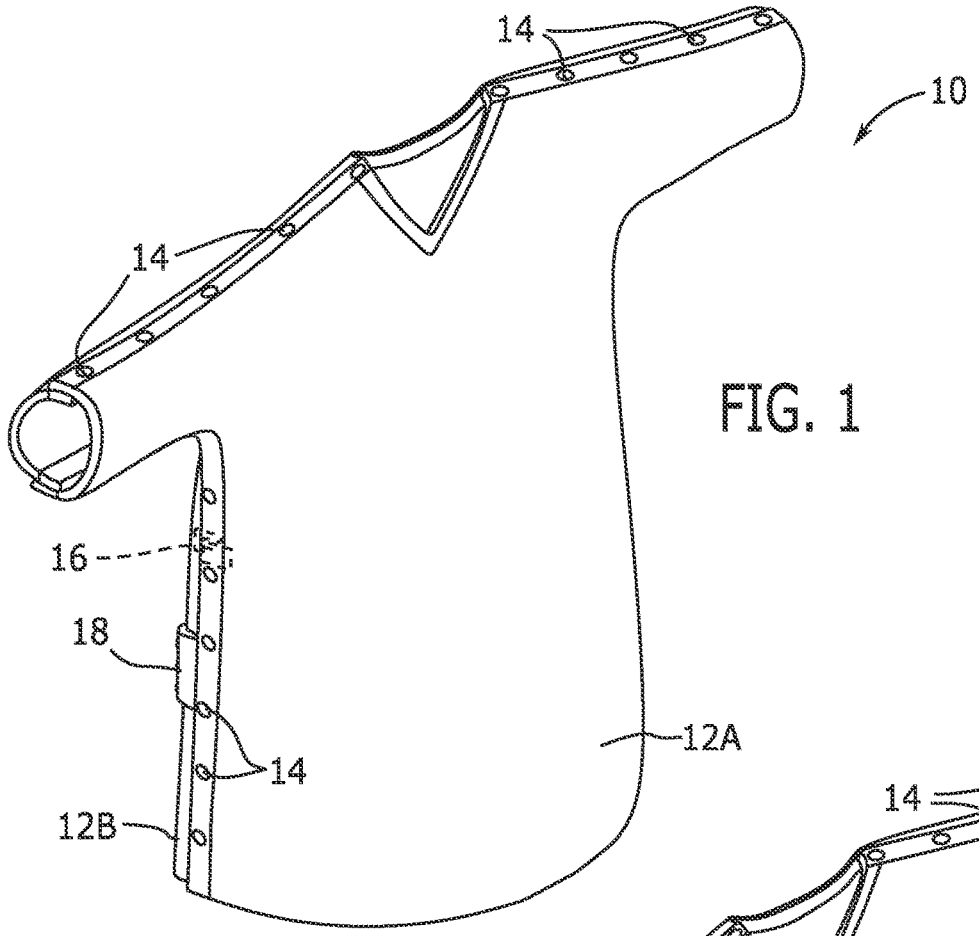
FIG. 1 is a front perspective view of a garment according to an embodiment of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a medical access garment configured to prevent unnecessary personal exposure.

The medical garment is designed and created for privacy, convenience, and minimize exposure, covering the private parts of the body while providing accessibility. It is MRI friendly with convenient and strategically positioned seam closures. Patients wearing the medical garment may regain their dignity and confidence, as well as experience convenience.

The garment may comprise a unitary front panel, a unitary back panel, an elastic member to attach the front and back panels. The garment may include a right edge portion, a left edge portion, a right arm portion, a left arm portion, a right shoulder/neck portion and a left shoulder/neck portion. An upper margin of the front panel and an upper margin of the back panel when in a fastened position form shoulder seams.

In some embodiments, the right shoulder/neck portion and the left shoulder/neck portion form a neck opening which may be configured as a Vee neck, a crew neck, or a boat neck.

The medical garment may be made of any suitable fabric and may include any suitable attachment means or closure. Nonlimiting examples of such closures may include seamed snaps, hook and loop fasteners, hook and loop tape, and zippers. The front panel and the back panel may be made of any suitable material. Any component of the garment may be made of protective material in response to COVID-19 needs and applications. In some embodiments, the elastic member may be a 4-inch piece of elastic to attach the front and back panels together.

In an exemplary embodiment, the medical garment is constructed and arranged to provide strategically placed closures. For example, the closures may be placed along the shoulders and sides of the garment. In some embodiments, the garment may further comprise trim borders along the right-side edge portion, the left side edge portion, the right shoulder/neck portion, and the left shoulder/neck portion.

In some embodiments, the medical garments may comprise one or more attachment means selected from the group consisting of zippers, hook and loop fasteners such as Velcro® fasteners, hook and loop tape such as Velcro® tape, snaps, snap tapes, buttons, button tapes and combinations thereof. The attachment means hold the garment together.

In some embodiments, the medical garment of the present invention may provide side snaps and removable elements created for the wearer's privacy and accessibility for the wearer, for medical patients and medical staff. One embodiment provides convenient snaps along the sides of the breast area so that it may be used for breast medical exams, mammograms and for breast feeding.

The garment may be configured as a gown, a pair of pajamas, a shirt, a pair of trousers, or a pair of underwear. The various configurations may collectively provide an unprecedented new line of medical garments for patients. The medical garment of the present invention provides an unprecedent option that meets the needs of today's patients. The garment provides a new choice of gowns, pajamas which incorporate closures along the shoulders and sides, hooded gowns, mother/baby breastfeeding and toddler wear, and robes. The pajama pants may comprise quick access to rear area and snap in/outside leg. Breastfeeding mothers may be provided multiple options with the mother/baby feeding garment-a design which is engineered to provide convenient options to open from either the top or the bottom to breastfeed and to hide baby's face or leave it exposed.

In an exemplary embodiment, the present invention may comprise a method for constructing or fabricating a medical garment. Manufacturing may include providing fabric and attachment means; cutting fabric into front panels and back panels; and affixing attachment means (as described hereinabove including but not limited to snaps, zipper, tapes including attachment elements, hook and loop fasteners, buttons, snaps, hook and eye fasteners or the like) along sides and shoulder. A middle pocket with a slit, e.g., a telemetry pocket, may be added to the front panel for medical equipment, such as halter monitors or a person's wallet.

In some embodiments, the attachment means may include at least one row of reinforced snaps on the side portions, at least one row of snaps at the side portions at a lower hip area of the side portions. Doubled up, two rows of snaps may be provided at the lower hip area of the side portions.

In some embodiments, the garment may have one or more flaps. Flaps may include, for example, a right front flap, a left front flap. The right front flap and left front flap may be constructed and arranged for use so that the flaps may reversibly cover a breast for access for feeding, breast exams, mammograms, or the like. The right front flap and the left front flap may snap upward on top of the breast to cover the breast, or downward and snap under breast to cover the breast. The right front flap and the left front flap may be removable and replaceable.

The medical garments may be worn by patients or clients at nursing homes, OB/GYN facilities, for mammograms, for at-home usage, at hospitals, at mid-wife centers, at outpatient facilities, and at medical spa or beauty spa facilities. In an exemplary embodiment, the medical garment of the present invention may be used by wearing to or at a nursing home, hospital, and/or OB/GYN examination to provide privacy and accessibility, e.g., for testing and/or treatment. Nonlimiting examples include medical examinations, MRI or other medical testing. The medical garment may be beneficially worn by a sick patient at home for easy changing and accessibility.

Figure 2:
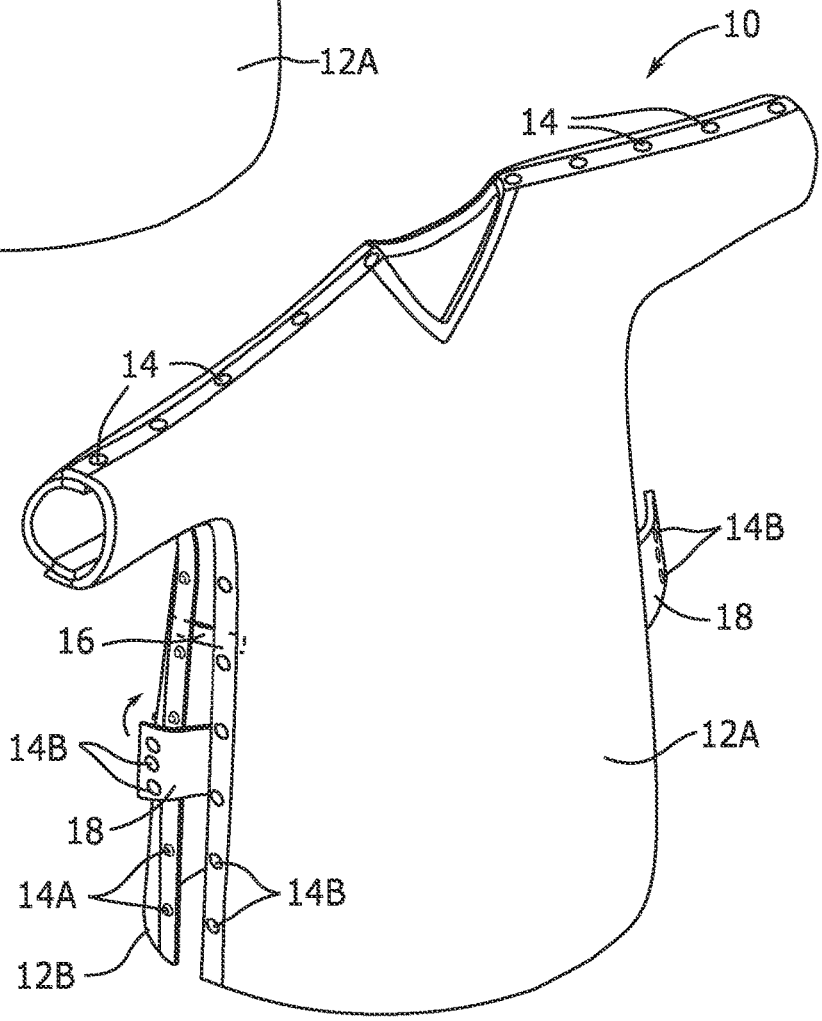
FIG. 2 is a front perspective view thereof, shown in a partially open position.
Figure 3:
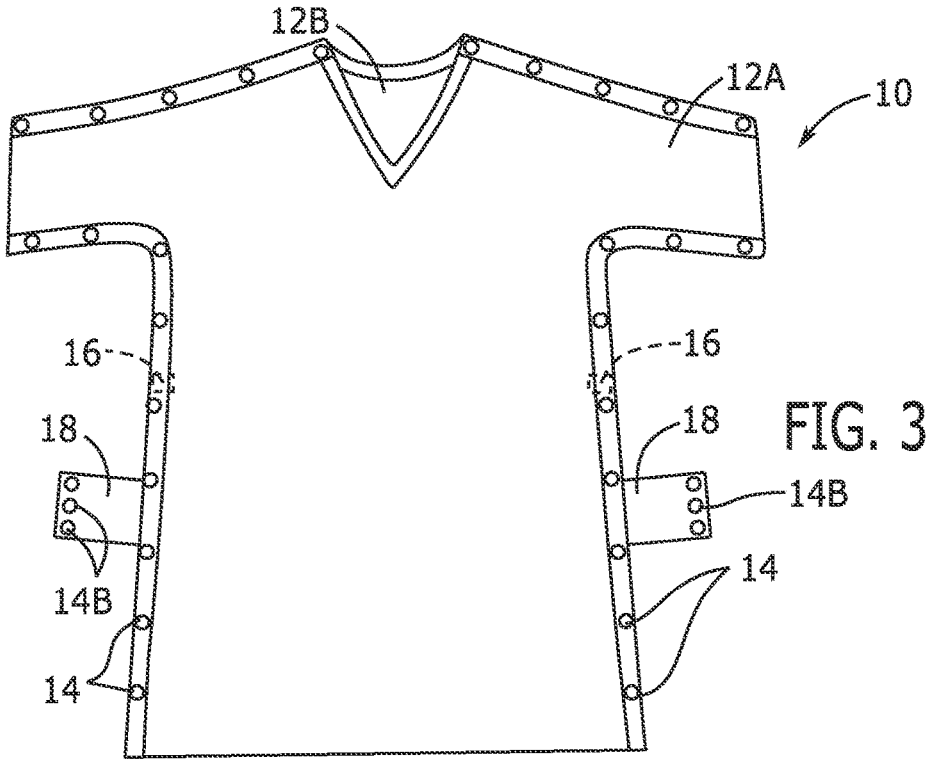
FIG. 3 is a front elevation view thereof.
Figure 4:
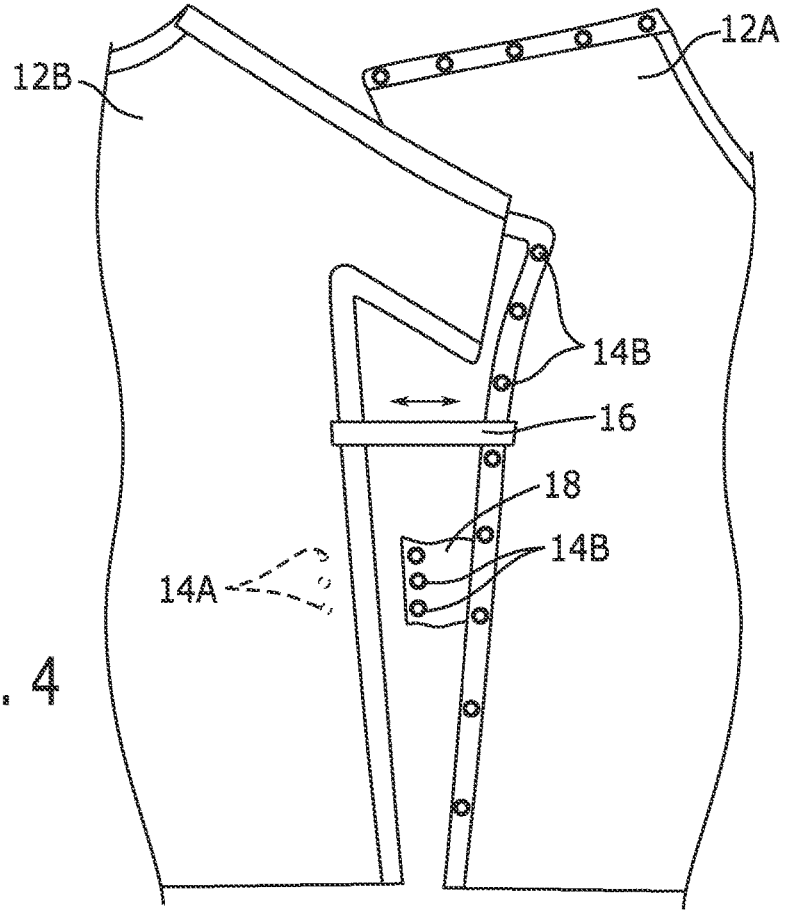
FIG. 4 is a detail view thereof, shown from the inside.
Figure 5:
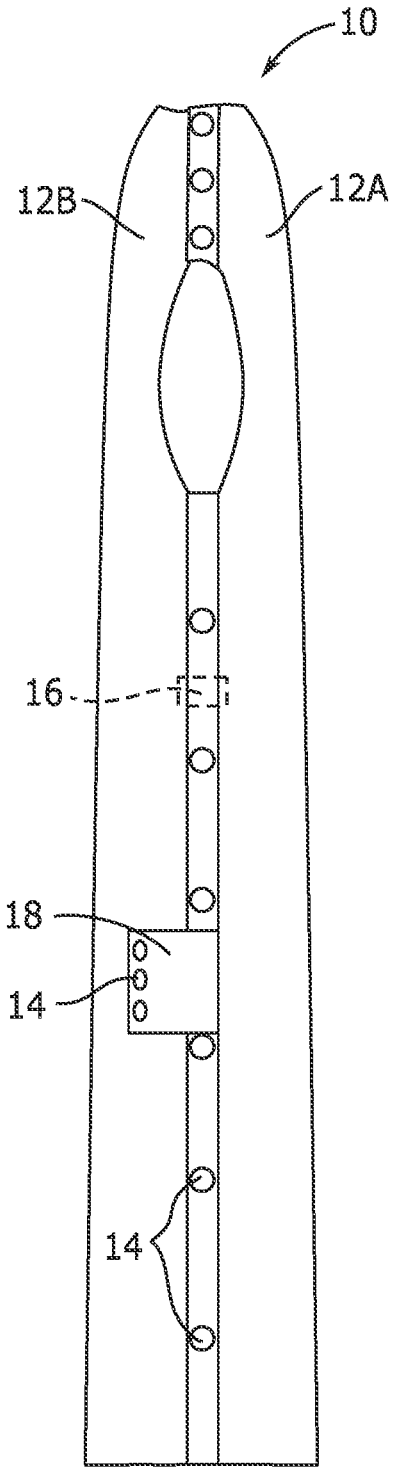
FIG. 5 is a side elevation view thereof.
Figure 6:
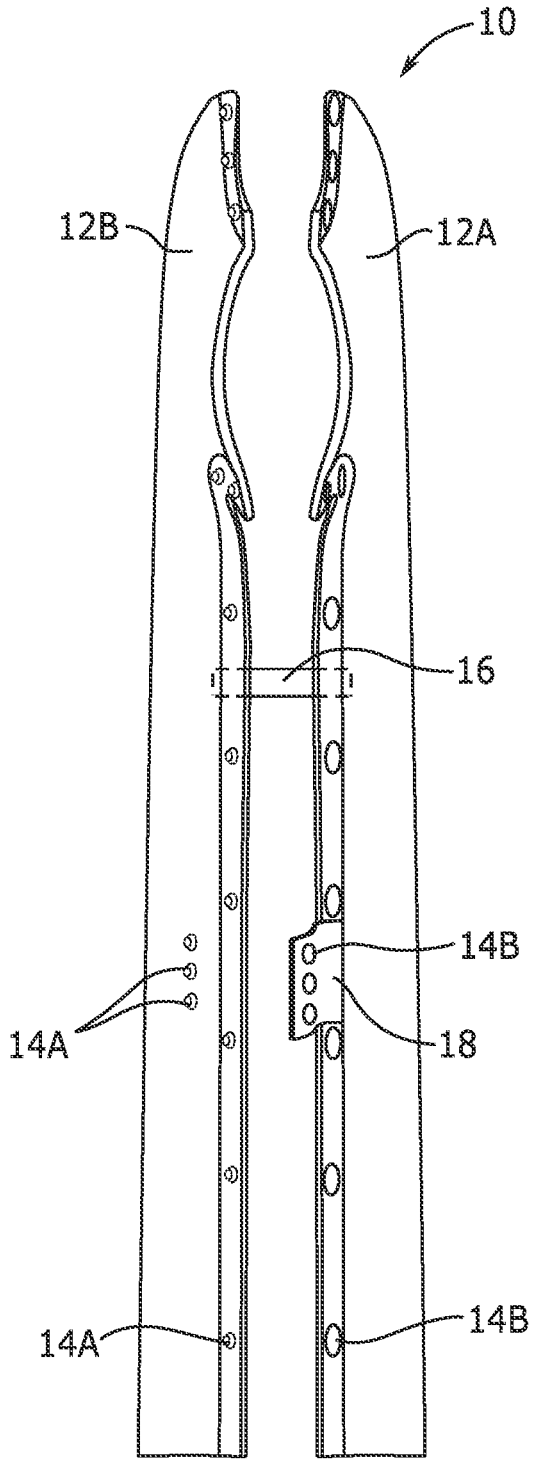
FIG. 6 is a side elevation view thereof, shown in an open position.

Referring to FIGS. 1 through 10, a garment 10 according to an embodiment of the present invention is shown in FIG. 1, in the form of a gown having a front panel 12A and a back panel 12B joined by an elastic band 16 (see FIG. 4) and fastened together with snaps 14 vertically along the left and right sides and along seams across the sleeves and shoulders. The front panel 12A and the back panel 12B together form a neck hole and a patient's torso or waist opening, as well as openings for extremities or sleeves. The snaps 14 are more clearly shown in FIG. 3. As shown in FIG. 2, the snaps 14 include a male portion 14A affixed to the rear panel 12B and a female portion 14B affixed to the front panel 12A. The left and right sides of the front panel 12A additionally have a reinforcement tab 18 affixed thereto. The tab 18 is fastened to the back panel 12B with snaps 14, as more clearly seen in FIGS. 5 and 6.

Figure 7:
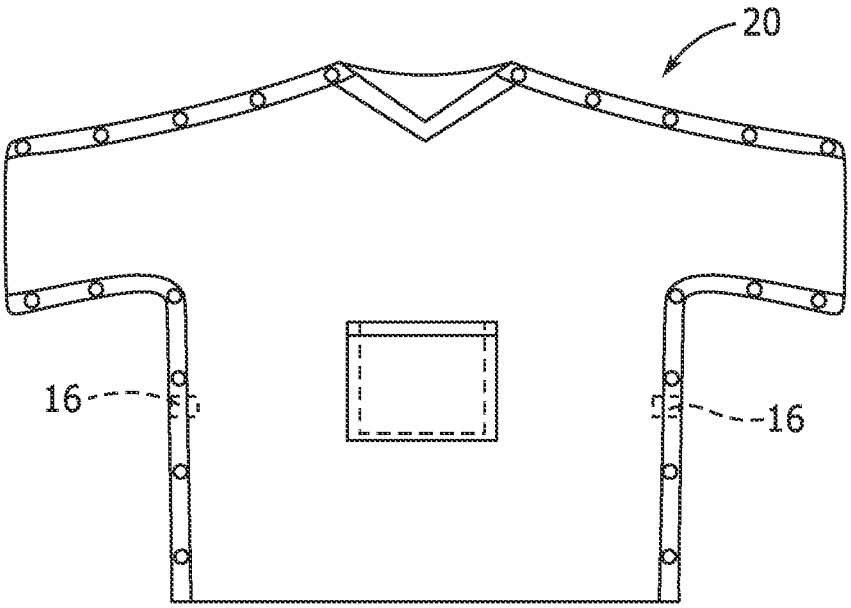
FIG. 7 is a front elevation view of a garment according to another embodiment of the present invention.
Figure 8:
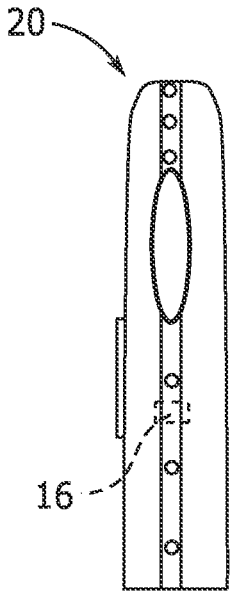
FIG. 8 is a side elevation view thereof.

FIGS. 7 and 8 illustrate another garment 20 according to an embodiment of the present invention, in a shirt configuration. The shirt 20 has a front panel 12A and a back panel 12B joined by an elastic band 16. The front panel 12A and the back panel 12B fasten together with snaps 14 to form a neck opening and a waist opening. The front panel 12A has a pocket stitched thereto.

Figure 9:
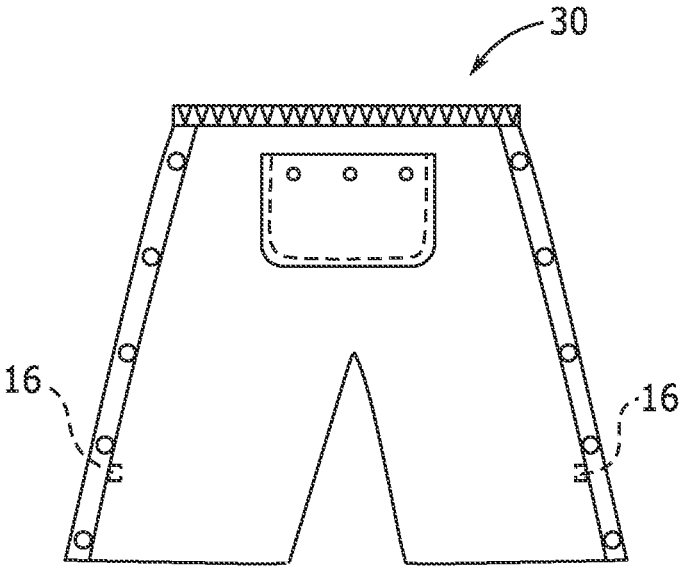
FIG. 9 is a front elevation view of a garment according to yet another embodiment of the present invention.
Figure 10:
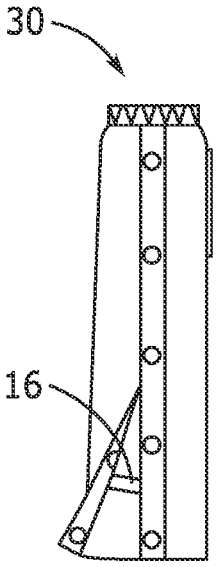
FIG. 10 is a side elevation view thereof.

Another garment 30 according to an embodiment of the present invention is shown in FIGS. 9 and 10, in a shorts configuration. The shorts 30 have a front panel and a back panel joined at the top by an elastic waist. The front and back panels are held together with elastic bands at the outer thigh and are fastened together with snaps 14. When in a fastened position, the garment 30 forms openings for the waist and extremities: leg holes or pant legs. As shown in FIG. 9, the garment 30 has a pocket stitched thereto with snaps to fasten it in a closed position.

For clarity, only those aspects of the system germane to the invention are described, and product details well known in the art are omitted. In addition, many embodiments of the present invention have application to a wide range of industries. To the extent the present application discloses a system, the method implemented by that system is within the scope of the present invention. Further, to the extent the present application discloses a method, a system of apparatuses configured to implement the method are within the scope of the present invention.

It should be understood, of course, that the foregoing relates to exemplary embodiments of the invention and that modifications may be made without departing from the spirit and scope of the invention as set forth in the following claims.

What is claimed is:

1. A medical access garment, comprising:

a unitary front panel having a first plurality of fasteners arrayed along a first left edge and a first right edge;

a unitary back panel having a second plurality of fasteners mated to the first plurality of fasteners, the second plurality of fasteners arrayed along a second left edge and a second right edge; and a first elastic member joining the first left edge to the second left edge between a first pair of the first plurality of fasteners and between a corresponding first pair of the second plurality of fasteners;

a second elastic member joining the first right edge to the second right edge between a second pair of the first plurality of fasteners and between a corresponding second pair of the second plurality of fasteners;

wherein when the first plurality of fasteners are coupled to the second plurality of fasteners such that the unitary front panel and the unitary back panel are in a fastened position, the medical access garment forms openings for a patient's torso and extremities.

2. The medical access garment of claim 1 wherein an upper margin of said unitary back panel has a third plurality of fasteners and an upper margin of said unitary front panel has a fourth plurality of fasteners, and wherein when the third plurality of fasteners and the fourth plurality of fasteners are coupled in a fastened position, the upper margin of said unitary back panel and the upper margin of said unitary front panel form a shoulder seam.

3. The medical access garment of claim 1, wherein the first elastic member is joined to the unitary front panel at a point midway along the first left edge and is joined to the unitary back panel at a corresponding point midway along the second left edge.

4. The medical access garment of claim 1, wherein the unitary front panel and/or the unitary back panel further comprise a telemetry pocket.

5. The medical access garment of claim 1, wherein the fasteners are selected from the group consisting of: snaps, snap tapes, hook and loop fasteners, hook and loop tape, buttons, button tapes, zippers, hook and eye fasteners, and any combination thereof.

6. The medical access garment of claim 1, wherein the unitary front panel and the unitary back panel are made of fabric with trim stitched thereto.

7. The medical access garment of claim 1, wherein the openings for extremities are leg holes or pant legs, and wherein the first pair of the first plurality of fasteners, the first pair of the second plurality of fasteners, the second pair of the first plurality of fasteners, and the second pair of the second plurality of fasteners are proximal to the openings for extremities.

8. The medical access garment of claim 1, further comprising a reinforcement tab affixed to the unitary front panel, the reinforcement tab having at least one fastener mated to at least one fastener affixed to the unitary back panel.

9. The medical access garment of claim 1, wherein the openings for extremities are a neck hole and sleeves, and wherein the first pair of the first plurality of fasteners, the first pair of the second plurality of fasteners, the second pair of the first plurality of fasteners, and the second pair of the second plurality of fasteners are proximal to the sleeves.

10. The medical access garment of claim 9, wherein the neck hole is configured as a Vee neck, a crew neck, or a boat neck.

* * * * *